US005344341A

United States Patent [19]

Yoshino

[11] Patent Number: 5,344,341

[45] Date of Patent: Sep. 6, 1994

[54] CONNECTOR HAVING ELECTROMAGNETIC SHIELDING FILM

[75] Inventor: Toshinori Yoshino, Tokyo, Japan

[73] Assignee: NEC Corporation, Tokyo, Japan

[21] Appl. No.: 41,314

[22] Filed: Mar. 31, 1993

[30] Foreign Application Priority Data

Mar. 31, 1992 [JP] Japan ..... 4-077465

[51] Int. Cl.[5] ..... H01R 13/648

[52] U.S. Cl. ..... 439/607; 439/931

[58] Field of Search ..... 439/92, 101, 108, 607, 439/608, 610, 587, 589, 701, 931

[56] References Cited

U.S. PATENT DOCUMENTS

| | | | |
|---|---|---|---|
| 3,551,874 | 12/1970 | Volinskie | 439/931 X |
| 4,812,136 | 3/1989 | Molitor | 439/589 |
| 5,015,192 | 5/1991 | Welsh et al. | 439/589 X |
| 5,037,332 | 8/1991 | Wilson | 439/931 X |

FOREIGN PATENT DOCUMENTS

| | | |
|---|---|---|
| 46-17736 | 5/1971 | Japan . |
| 50-55892 | 5/1975 | Japan . |
| 58-165284 | 9/1983 | Japan . |

*Primary Examiner*—Khiem Nguyen

*Attorney, Agent, or Firm*—Sughrue, Mion, Zinn, Macpeak & Seas

[57] ABSTRACT

A connector includes first and second connector halves 100 and 200 in which contact pins 1 and 4 are respectively held by projections 3*a* and 6*a* protruding from insulation plates 3 and 6. The insulation plates are housed within an insulation housing (2, 5) whose internal and external surfaces are coated with a conductive film, so that crosstalk between the neighboring contact pins is prevented, and all elements can be constructed by molding.

4 Claims, 3 Drawing Sheets

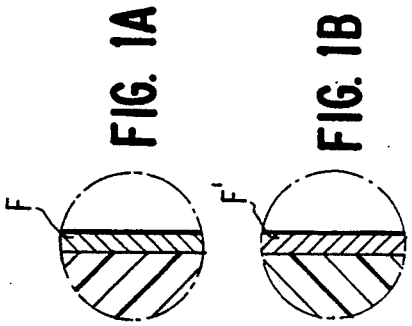
FIG. 1A
FIG. 1B
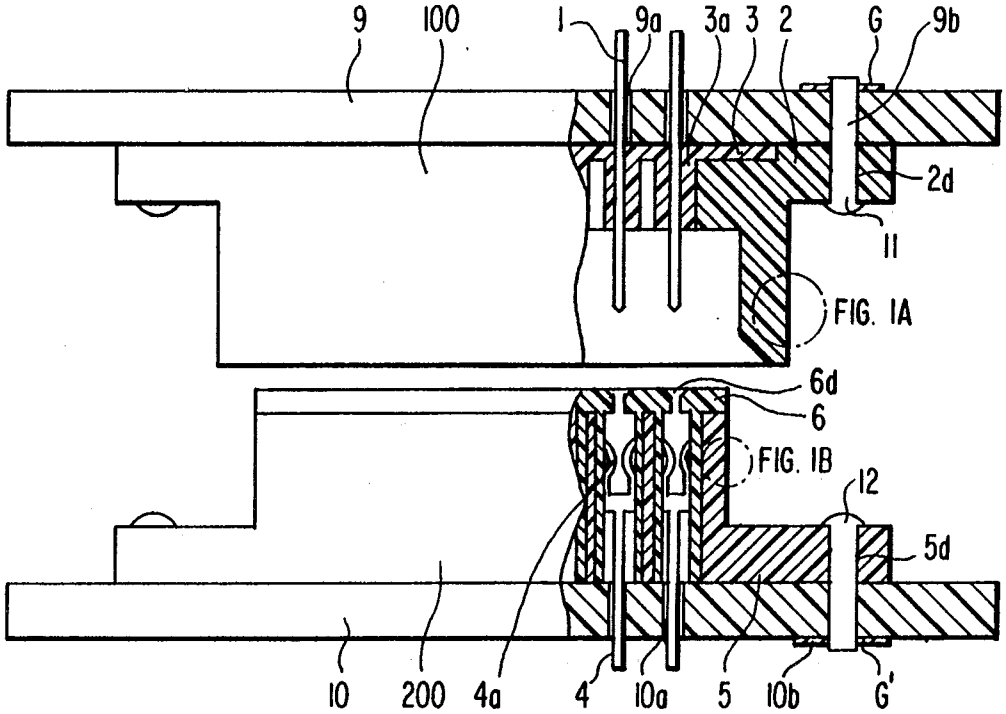
FIG. 1

CONNECTOR HAVING ELECTROMAGNETIC SHIELDING FILM

BACKGROUND OF THE INVENTION

The present invention relates to a connector fixed to a printed circuit board via a plurality of contact pins, and more particularly to a connector constructed for electromagnetic shielding.

One known connector comprises a pair of insulating connector housings one of which holds a plurality of female contact pins and the other holds a plurality of male contact pins. Usually, the female and male contact pins are press-inserted or press-fitted into holes of the respective connector housings and separately located in the connector housings by leaving a predetermined space. When the two connector housings are coupled with each other, the male contact pins engage and electrically connect with the female contact pins.

However, in the above-described conventional connector, outer or external noise is easily received by the female and male contact pins. To prevent the external noise, a connector disclosed in the Japanese Patent Disclosure Gazette No. 50-55892 published on May 16, 1975, has an insulating housing whose external surface is coated with a conductive film, part of which is connected to a grounding pin among the contact pins.

In this connector, however, only shielding against external noise signals to the connector housings is provided, but shielding against crosstalk between neighboring contact pins in the connector housings is not provided.

Crosstalk between contact pins is cut off in a connector described in the Japanese Patent Disclosure Gazette No. 58-165284 published on Sep. 30, 1983. In this connector, the two connector housings, which are respectively holding the female and male contact pins, are made of metal, and the contact pins are respectively fixed in holes of the metal connector housings via cylindrical insulators so that they do not directly come into contact with the connector housings.

However, as the pair of connector housings is made of metal, the connector housings cannot be molded or fabricated easily, and the boring of the holes is troublesome. Moreover, a large number of cylindrical insulators have to be inserted into the holes in the connector housings one-by-one, which results in tedious and time consuming work.

SUMMARY OF THE INVENTION

An object of the present invention, therefore, is to provide a crosstalk-free connector permitting the prevention of crosstalk between contact pins, and moreover, readily permitting manufacture and assembly of the constituent parts.

According to the present invention, a connector is provided comprising a first connector half which holds first contact pins and a second connector half which holds second contact pins. The first connector half comprises a first insulation plate provided with parallel projections in which the first contact pins are held, and a first insulation housing provided with holes, for receiving the projections, and coated with a conductive film on internal and external surfaces. The second connector half comprises a second insulation plate provided with parallel projections in which the second contact pins are held, and a second insulation housing provided with holes, for receiving the projections of the second insulation plate, and coated with a conductive film on internal and external surfaces.

The first and second connector halves are coupled with each other to contact the first contact pins with the second contact pins, and the conductive films coated on the first and second housings are connected to ground.

BRIEF DESCRIPTION OF THE DRAWINGS

FIG. 1 is a partially sectioned front view of a connector embodying the invention;

FIG. 1A and FIG. 1B are respectively enlarged section views of the circled portions of the connector in FIG. 1;

DETAILED DESCRIPTION OF THE PREFERRED EMBODIMENTS

Figure 2:
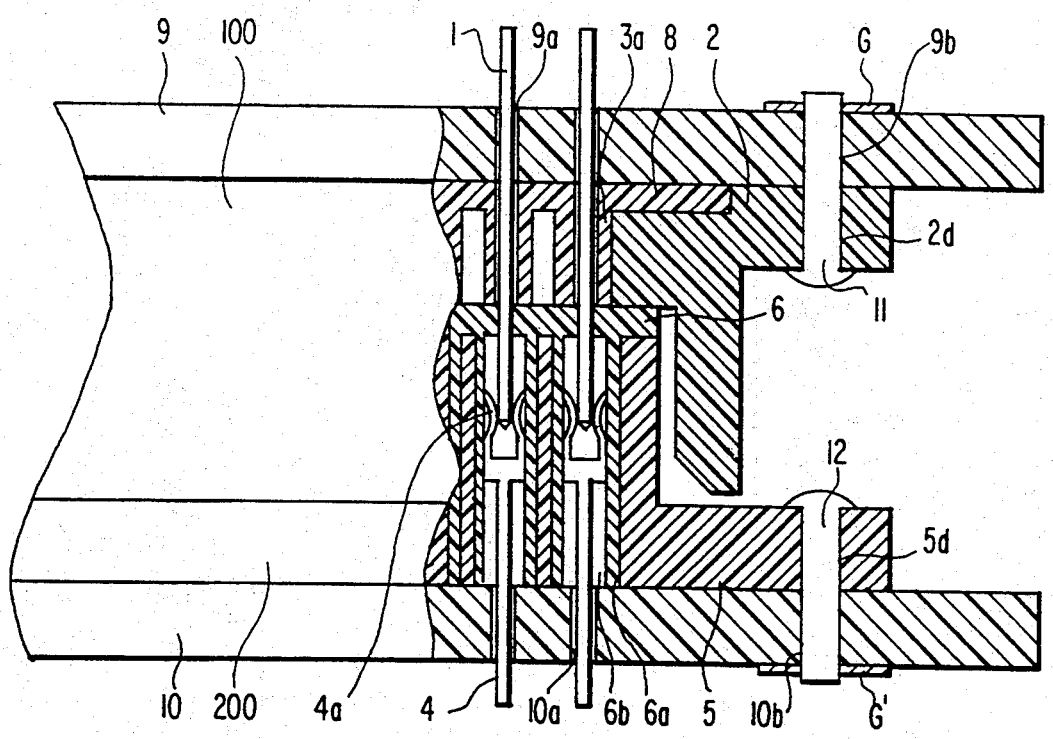
FIG. 2 is an enlarged and partially sectioned front view of the connector in FIG. 1 after completing coupling.

In FIG. 1, a first connector half 100 is fixed on a printed circuit board 9, and a second connector half 200 is fixed on a printed circuit board 10. The first connector half 100 is a male connector in which male contact pins 1 are press-inserted or press-fitted. The second connector half 200 is a female connector in which the female contact pins 4 are press-inserted or press-fitted. The male and female contact pins 1 and 4 are respectively inserted into the through-holes **9*a* and 10*a*, which are covered with a solder compatible material (not shown), of the printed circuit boards 9 and 10, and soldered within the through-holes. When the first and second connector halves 100 and 200 are coupled as shown in FIG. 2, the tips of the male contact pins 1 are inserted into the connector half 200 and coupled to the respective contact springs 4*a* of the female contact pins 4 so that circuits on the printed circuit boards 9 and 10 are connected through the contact pins 1 and 4**.

Figure 3:
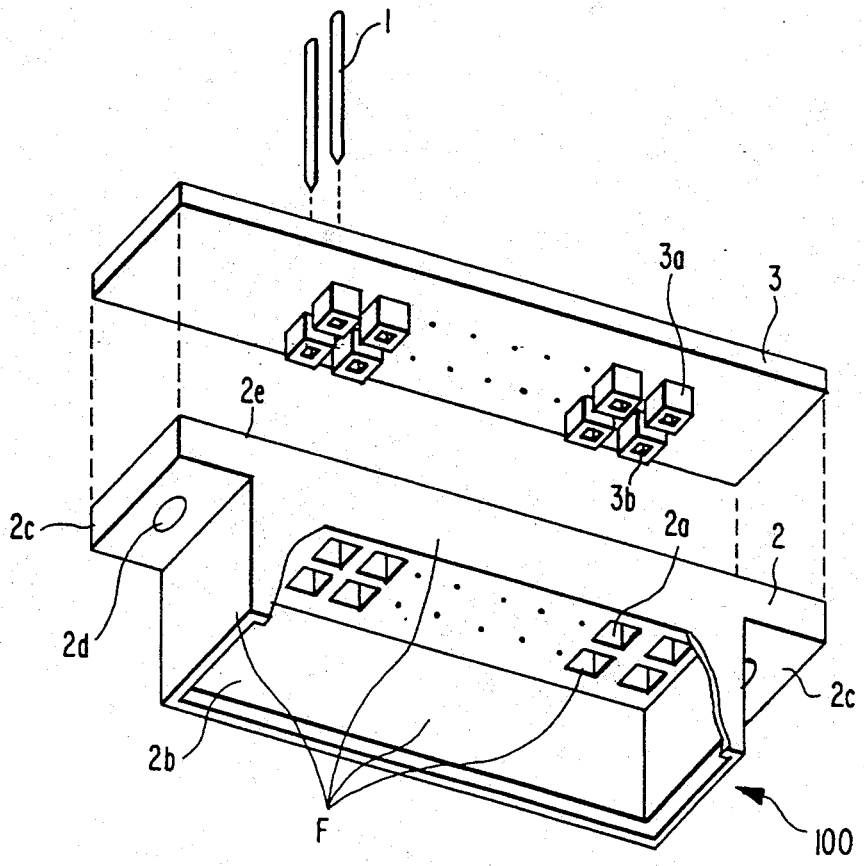
FIG. 3 is an exploded perspective view of a first connector half shown in FIG. 1 and FIG. 2.

As shown in FIG. 3, the first connector half 100 comprises a first housing 2 which is fixed to the printed circuit board 9 (see FIG. 1), and a first insulation plate 3. The first insulation plate 3 has a plurality of square pillar projections **3*a* extending perpendicular to the plate 3. The square pillar projections 3*a* are located at regular intervals and holes 3*b* are bored in the center axes of the projections 3*a*. The male contact pins 1 are press-inserted in the holes 3*b***.

The first housing 2 is provided with a plurality of square holes **2*a* for receiving the square pillar projections 3*a*, frame 2*b* for receiving the second connector half 200, and flange 2*c* having holes 2*d*. Each hole 2*a* has a depth which is equal to the length of each square pillar projection 3*a*. The square pillar projections 3*a* are inserted from the bottom 2*e* of the housing 2 into the holes 2*a*. There is a recess in the bottom 2*e* for fitting therein the first insulation plate 3**.

The first housing 2 is formed of an insulation material, such as synthetic resin, and all the internal and external surfaces including the surrounding surfaces in the holes **2*a* are coated with a conductive film F formed by electroplating or non-electroplating (e.g., dipped in a bath of liquified film material). Moreover, the conductive film is connected to a grounding circuit G provided on the printed circuit board 9 via a screw 11 fixed in the holes 2***d* and 9*b* as shown in FIG. 1.

Therefore, the crosstalk between the neighboring male contact pins 1 is prevented by the conductive film coated on the internal surfaces of housing 2, and assembly of the connector half 100 is simple because it is completed by coupling the insulation plate 3 into the first housing 2.

Figure 4:
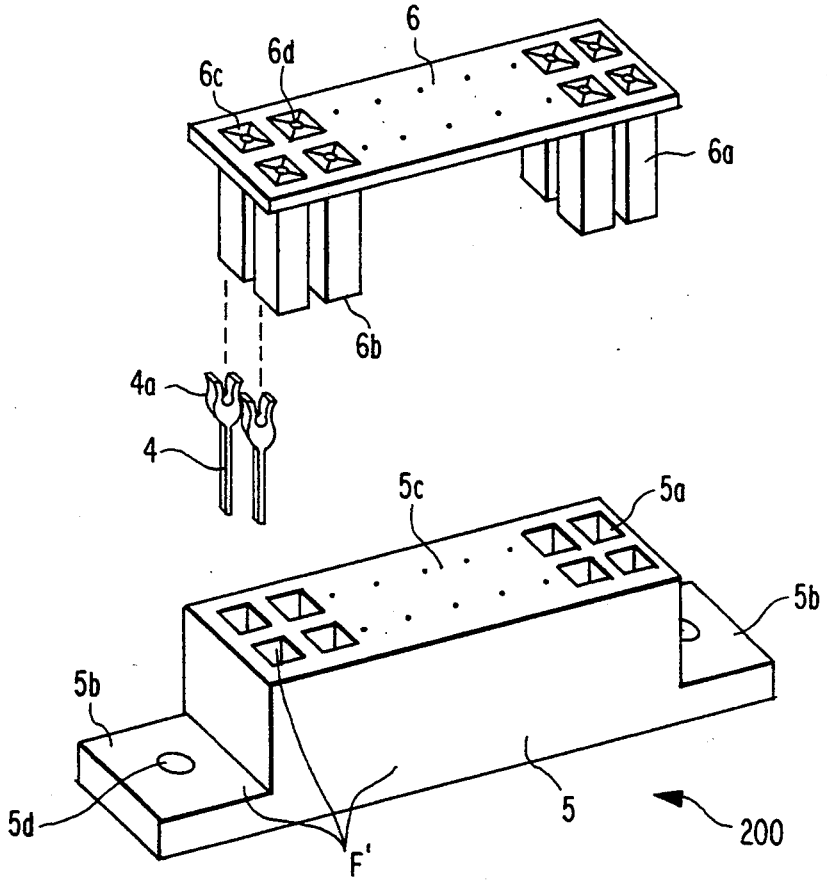
FIG. 4 is an exploded perspective view of a second connector half shown in FIG. 1 and FIG. 2.

As shown in FIG. 4, the second connector half 200 comprises a second housing 5 which is fixed to the printed circuit board 10 (see FIG. 1), and a second insulation plate 6. The second insulation plate 6 is provided with a plurality of square pillar projections 6*a* extending perpendicular to the plate 6. Holes 6*b* (see FIG. 2) are bored at the center axes of the square pillar projections 6*a*. The female contact pins 4 are press-inserted from the tips of the projections 6*a* into the respective holes 6*b* and then the contact springs 4*a* of the female contact pins 4 are respectively positioned at the middle portion of the holes 6*b*. Each hole 6*b* is provided with a small hole 6*d* for passing the male contact pin 1 and a recess 6*c* surrounds the small hole 6*d*. Each recess 6*c* is constructed so that the tip of the corresponding male contact pin 1 is readily led into the hole 6*b* to contact with the contact spring 4*a*.

The second housing 5 is provided with holes 5*a* and a flange 5*b*. Each hole 5*a* has a depth which is equal to the length of the corresponding projection 6*a*. The projections 6*a* are inserted from a top face 5*c* of the second housing 5 into the holes 5*a*. All the internal and external surfaces of the housing 5 are coated with a conductive film F′, and the conductive film is connected to a grounding circuit G′ provided on the printed circuit board 10 via a screw 12 fixed in the holes 5*d* and 10*b* as shown in FIG. 2.

Therefore, crosstalk between the neighboring female contact pins 4 is prevented by the conductive film coated on the internal surfaces of the second housing 5, and assembly of the second connector half 200 is simple because it is completed by coupling the insulation plate 6 to the housing 5.

When the first connector half 100 is coupled to the second connector half 200 as shown in FIG. 2, each coupled pair of contact pins 1 and 4 are electrically separated from the housings 2 and 5 by the square pillar projections 3*a* and 6*a* of the insulation plates 3 and 6, and crosstalk between the neighboring contact pins is prevented by the conductive films coated on the internal surfaces of the housings 2 and 5.

In the above embodiment, the ground potential of the printed circuit boards 9 and 10 can be connected via one of the coupled contact pins 1 and 4. The first and second housings 2 and 5 and the first and second insulation plates 3 and 6 can be constructed of molded plastics.

It will be appreciated that modifications may be made in the present invention. For example, although the insulation plate 3 is inserted from the bottom 2*e* of the first housing 2 and the insulation plate 6 is inserted from the top 5*c* of the housing 5, the insulation plates can be inserted from the opposite side, respectively. Another modification is to change the configurations of the holes 2*a* and 5*a*, and the projections 3*a* and 6*a*. For example, the projections 3*a* and 6*a* can be cylindrical ones.

Although the present invention has been fully described by way of the preferred embodiments thereof with reference to the accompanying drawings, various changes and modifications will be apparent to those having skill in this field. Therefore, unless these changes and modifications otherwise depart from the scope of the present invention, they should be construed as included therein.

What is claimed is:

1. A connector comprising a first connector half which holds first contact pins, and a second connector half which holds second contact pins;

said first connector half comprising:

a first insulation plate including a plurality of parallel projections in which said first contact pins are held, and a first insulation housing including a plurality of holes for receiving said projections, said first insulation housing being coated with a conductive film on internal and external surfaces thereof; and said second connector half comprising:

a second insulation plate including a plurality of parallel projections in which said second contact pins are held, and a second insulation housing including a plurality of holes for receiving said projections of said second insulation plate, said second insulation housing being coated with a conductive film on internal and external surfaces thereof;

said first and second connector halves being coupled with each other to contact said first contact pins with said second contact pins;

wherein said conductive films respectively coated on said first and second insulation housing are each connected to a ground.

2. The connector of claim 1, wherein said projections of said first insulation plate are respectively provided with holes for holding said first contact pins in parallel, and said projections of said second insulation plate are respectively provided with holes for holding said second contact pins in parallel.

3. The connector of claim 2, wherein a tip of each of said first contact pins extends from a corresponding said projection of said first insulation plate, and a tip of each of said second contact pins is located within a hole of a corresponding said projection of said second insulation plate.

4. The connector of claim 3, wherein said second contact pins are provided with contact springs for holding the tips of said first contact pins.

* * * * *